US005154728A

United States Patent [19]

Craven et al.

[11] Patent Number: 5,154,728

[45] Date of Patent: Oct. 13, 1992

[54] METHOD FOR PATTERNING GARMENTS USING A METHOCEL BATH: RANDOM DISCHARGE PATTERN EFFECT

[75] Inventors: Richard Craven, Fort Mill, S.C.; Brian Scism; Robert Waddell; L. Thomas Holst, all of Charlotte, N.C.

[73] Assignee: Dexter Chemical Corporation, Bronx, N.Y.

[21] Appl. No.: 827,845

[22] Filed: Jan. 29, 1992

Related U.S. Application Data

[63] Continuation of Ser. No. 528,586, May 24, 1990, abandoned.

[51] Int. Cl.[5] ..... D06D 5/15

[52] U.S. Cl. ..... 8/461; 8/108.1; 8/111; 8/115; 8/457; 8/465; 8/478; 8/483; 8/486; 8/618; 8/653; 8/918

[58] Field of Search ..... 8/457, 461, 483, 486

[56] References Cited

U.S. PATENT DOCUMENTS

| | | | |
|---|---|---|---|
| 1,024,668 | 4/1912 | Becke | 8/467 |
| 1,846,845 | 2/1932 | Clark | 8/486 |
| 1,905,346 | 4/1933 | Dreyfus et al. | 8/464 |
| 1,905,347 | 4/1933 | Dreyfus et al. | 8/464 |

*Primary Examiner*—A. Lionel Clingman
*Attorney, Agent, or Firm*—Curtis, Morris & Safford

[57] ABSTRACT

A method for creating a design on a garment or fabric comprising preparing a patterning medium comprising a cellulose ether in a trough, adding onto the surface of said medium a fabric oxidizing or reducing agent in a desired pattern, contacting a garment or fabric with said surface of said medium for a time sufficient to permit the oxidizing or reducing agent to be transferred onto said garment and to partially oxidize or reduce the color in the garment or fabric, removing said garment or fabric from said medium, treating said garment or fabric with a neutralizing agent so as to neutralize excess oxidizing or reducing agent on said garment or fabric, and rinsing said garment or fabric with water so as to remove excess cellulose ether on said garment or fabric.

6 Claims, No Drawings

METHOD FOR PATTERNING GARMENTS USING A METHOCEL BATH: RANDOM DISCHARGE PATTERN EFFECT

This application is a continuation of application Ser. No. 07/528,586, filed May 24, 2990, abandoned.

BACKGROUND OF THE INVENTION

This invention relates to a method for creating a design on fabric and/or garments.

Over the years, in response to changing fashion demands, various methods have been developed for patterning fabrics. An early example of such a method is disclosed in U.S. Pat. No. 1,024,668, which teaches a method for transferring a pattern of a color changing agent from a paper web to a fabric. The pattern may be formed on the paper web by application of discharges, which are agents for removing color from selected areas of a substrate which has been previously colored. The actual transfer of the pattern on the paper web to the fabric is effected in various ways, including employing a roller or the pressure of an engine. Such a method, however, employing large cumbersome machinery, is time consuming, labor intensive and costly.

U.S. Pat. No. 1,905,346 discloses a method of producing color effects on fabric, particularly fabric containing organic derivatives of cellulose, by discharge printing with an oxidizing agent. More specifically, the fabric is treated with a discharge paste including a thickening agent, e.g., cellulose ethers, and an oxidizing agent.

In other prior methods for imprinting textiles, a coloring agent floating upon the surface of a liquid bath is transferred to a fabric or garment so as to create a desired effect. U.S. Pat. No. 1,846,845 discloses a process and apparatus for imparting a variegated design to webs of air-porous material, particularly textile fabrics, wherein a design of color is floated on the surface of a carrier liquid, preferably water, and is taken off the surface by a web of the fabric to be patterned.

OBJECTS OF THE INVENTION

It is a primary object of this invention to provide a method for creating a design on fabric, particularly denim garments, which provides a satisfactory and desired appearance on the garment.

It is another object of this invention to provide a method which is convenient to employ and more efficient than present methods of imprinting fabrics.

It is a further object of this invention to provide a method which, when used in conjunction with a conventional washing process, will not damage or excessively wear fabrics and garments, and will result in garments having a desired imprinted design without involving a high level of textile wear.

SUMMARY OF THE INVENTION

Broadly, the invention is in a method for creating designs on fabrics wherein a garment is contacted with the surface of a patterning medium, which surface has upon it a pattern formed from an oxidizing or reducing agent. The pattern is transferred to the garment and the oxidizing or reducing agent creates the desired color effect on the garment. More specifically, the patterning medium, which comprises cellulosic ethers, e.g., hydroxypropyl methylcellulose, having viscosities broadly in the range of from 10 to 100,000 cp as measured in 2% aqueous solutions at 20° C., is contained in a trough. Oxidizing or reducing agent is added to the surface of the cellulosic ether in a desired pattern before the garment is contacted with that surface. After the garment has been contacted, it may be treated by art-known methods with neutralizing agents, rinsed, and further processed.

DETAILED DESCRIPTION OF THE INVENTION

The object of the invention, the creation of a desired design on fabric, is achieved by preparing a patterning medium comprising one or more grades of cellulose ethers, preferably hydroxypropyl methylcellulose ethers. The patterning medium is contained in a trough having a depth of several inches and a width and length sufficient to accommodate the garment which is to be patterned. Advantageous results are obtained where the trough size conforms to the garment size. The method involves the step of adding to the surface of the patterning medium, by means of random dripping, splashing, spraying, or pouring, an oxidizing or reducing agent. The oxidizing or reducing agent and the patterning medium are then moved about, i.e., swirled, together, with a rake or spatula or the like, so as to form a desired pattern on the patterning medium surface.

A garment is then placed so that one side of its exterior surface contacts the patterning medium surface, for a time sufficient to permit the oxidizing or reducing agent to be transferred onto the garment and to partially oxidize or reduce the color in the garment or fabric. The garment or fabric is then turned over and the exterior surface of its other side contacted with the patterning medium. Generally, the contact time is from 10 to 600 seconds per side. More typically, the contact time is 20 to 40 seconds per side. In a preferred embodiment, the contact time is about 1 minute per side.

The garment is then rinsed with a neutralizing agent to neutralize any excess oxidizing or reducing agent on the garment, and further rinsed with water to remove any excess cellulose ethers from the garment. The finished garment will have patterned thereupon a design which substantially reflects the design pattern which was initially placed on the surface of the patterning medium.

Any of the commercially available cellulosic ethers may be employed to form the pattern. By way of example, hydroxypropyl methylcellulose having viscosities of 50 to 4000 cp for 2% aqueous solutions at 20° C. are known and commercially available as Methocel E-50 and E-4M, respectively (Dow Chemical Company registered trademarks. Hydroxypropyl methylcellulose as used in accordance with the invention is known and commercially available as Klucel (a Hercules, Inc., registered trademark). A preferred medium is hydroxypropyl methylcellulose having a viscosity from 10 to 100,000 cp as measured in a 2% aqueous solution at 20° C.

The patterning agent may be either an oxidizing agent or a reducing agent. Any of the known oxidizing and reducing agents may be employed in the method of the invention. For example, oxidizing agents such as the alkali and alkaline earth metal salts of hypochlorous acid, e.g., sodium hypochlorite, may be employed to advantage. The strength of the bleaching agent and the amount used depends on the desired look of the finished garment. Broadly, a solution of 0.5 to 15.0% by weight of sodium hypochlorite may be used to pattern the surface of the medium and from 10 to 1000 ml of such a solution may be employed for each garment to be patterned.

The garment or fabric to be imprinted with the desired pattern is generally made of denim, but any cotton or cotton-blended garment or fabric, whether woven or knitted, may be patterned using the process of the invention.

EXAMPLE 1

A trough which is 30" wide, 40" long, and 3" deep is substantially filled with a 2% by weight solution of hydroxyethylcellulose. The viscosity of the solution is 3000 cps at 25° C as measured by a No. 6 spindle 20 rpm Brookfield Viscometer.

A 2% by weight solution of sodium hypochlorite is applied to the surface of the medium in the trough with a spray bottle. About 50 ml are used for each side of the garment to be patterned. After the hypochlorite solution has been sprayed upon the surface, it is lightly mixed into the base material with a spatula.

A denim garment is then positioned on the surface of the medium for about 30 seconds and then flipped over and the other side maintained for about 30 seconds.

The garment is then further processed to neutralize the oxidizing agent and to wash off excess base material. The garment is placed in a 1% solution of sodium bisulfite and then washed in a standard washing machine with a solution of 3% sodium bisulfite for five minutes at 120° F., and thereafter rinsed with water for 4 minutes at 160° F. The garment may thereafter be further processed as is known in the art.

What is claimed is:

1. A method of patterning a dyed fabric or garment which comprises:

(a) filling a trough with a viscous aqueous solution of cellulose ether;

(b) adding an oxidizing agent to the surface of the cellulose ether solution in the trough;

(c) preparing the surface of the solution in the trough by moving the oxidizing agent on the surface of the cellulose ether solution so as to form a desired pattern of oxidizing agent on the surface of the cellulose ether solution;

(d) placing the fabric or garment to be patterned into contact with the prepared surface for a time sufficient to permit the oxidizing agent present on the surface of the cellulose ether solution to effect a change in the fabric or garment to be patterned, so as obtain a desired pattern on the surface of the fabric or garment;

(e) removing the patterned fabric or garment from contact with the trough contents;

(f) rinsing the patterned fabric or garment with a neutralizing agent to neutralize any excess oxidizing agent remaining on the patterned fabric or garment; and (g) rinsing the patterned fabric or garment with water so as to remove any excess solution from the patterned fabric or garment.

2. The method of claim 1, wherein the cellulose ether is hydroxypropyl methylcellulose.

3. The method of claim 1, wherein the oxidizing agent is sodium hypochlorite.

4. The method of claim 1, wherein from 0.5 to 15.0% by weight of sodium hypochlorite solution is used as oxidizing agent which agent is sprayed onto the surface of the cellulose ether solution.

5. The method of claim 4, wherein the neutralizing agent is 1 to 3% by weight aqueous solution of sodium bisulfite.

6. A method of patterning a denim fabric or garment which comprises:

(a) preparing a cellulose ether solution which comprises 2% by weight aqueous solution of hydroxypropyl methylcellulose ether, having a viscosity of 10 to 100,000 cp, at about 20° C., which cellulose ether solution is contained in a trough of a size sufficient to accommodate the fabric or garment to be patterned;

(b) spraying a 0.5 to 15% by weight aqueous sodium hypochlorite solution onto the surface of the cellulose ether solution in the trough;

(c) swirling the sodium hypochlorite solution lightly into the surface of the cellulose ether solution so as to form a desired pattern of sodium hypochlorite solution on the surface of the ether solution;

(d) placing a denim fabric or garment on the surface of the trough contents for 10 to 60 seconds;

(e) turning the denim fabric or garment over and treating the reverse side of the denim fabric or garment for 10 to 600 seconds;

(f) removing the patterned denim fabric or garment from contact with the trough contents;

(g) rinsing the patterned fabric or garment with a 1 to 3% by weight aqueous solution of sodium bisulfite to neutralize any excess sodium hypochlorite solution remaining on the patterned fabric or garment; and (h) washing and rinsing the patterned fabric or garment with water at about 160° F. to remove any excess solution from the patterned fabric or garment.

* * * * *